US010570648B2

(12) United States Patent
Estrada

(10) Patent No.: US 10,570,648 B2
(45) Date of Patent: Feb. 25, 2020

(54) INERTIA LOCKING DEVICE FOR VEHICLE LATCH

(71) Applicant: INTEVA PRODUCTS, LLC, Troy, MI (US)

(72) Inventor: Eduardo Estrada, Chihuahua (MX)

(73) Assignee: INTEVA PRODUCTS, LLC, Troy, MI (US)

( * ) Notice: Subject to any disclaimer, the term of this patent is extended or adjusted under 35 U.S.C. 154(b) by 873 days.

(21) Appl. No.: 14/984,390

(22) Filed: Dec. 30, 2015

(65) Prior Publication Data

US 2017/0191290 A1 Jul. 6, 2017

(51) Int. Cl.

| | |
|---|---|
| ***E05B 77/42*** | (2014.01) |
| ***E05B 77/54*** | (2014.01) |
| ***E05B 85/10*** | (2014.01) |
| ***E05B 77/06*** | (2014.01) |

(52) U.S. Cl.
CPC ..... *E05B 77/42* (2013.01); *E05B 77/06* (2013.01)

(58) Field of Classification Search
CPC ..... E05B 77/54; E05B 85/10; E05B 77/42; E05C 19/10; E05C 3/14; E05C 3/124
See application file for complete search history.

(56) References Cited

U.S. PATENT DOCUMENTS 9,611,676 B2 * 4/2017 Bendel ..... E05B 79/10

FOREIGN PATENT DOCUMENTS

WO WO2014/187445 * 11/2014 ..... E05B 77/06

* cited by examiner

*Primary Examiner* — Kristina R Fulton
*Assistant Examiner* — Thomas L Neubauer
(74) *Attorney, Agent, or Firm* — Cantor Colburn LLP

(57) ABSTRACT

A vehicle latch is provided herein. The vehicle latch having: a claw rotationally mounted to the latch for movement about an axis; a pawl rotationally mounted to the latch for movement about an axis between a first position and a second position, wherein the pawl restricts movement of the claw when it is in the first position and wherein the pawl does not restrict movement of the claw when it is in the second position; and an inertia locking device for limiting movement of the pawl towards the second position, wherein the inertia locking device includes a mass-spring damper system configured to react to acceleration forces applied to the pawl in order to limit the movement of the pawl.

16 Claims, 4 Drawing Sheets

INERTIA LOCKING DEVICE FOR VEHICLE LATCH

BACKGROUND

Various embodiments of the present invention relate to a vehicle latch and more particularly, a vehicle latch with an inertia locking device.

Some inertial locking systems for vehicle door latches are integrated in the vehicle handle door. If however, the inertia locking system was integrated into the latch, the weight of the vehicle door handle could be reduced. In addition, integration of the system into the latch may provide further cost savings.

Accordingly, it is desirable to provide a vehicle latch with an inertia activated blocking mechanism located in the vehicle latch. It is also desirable to provide an inertia activated blocking mechanism that is adjustable to different forces without having to increase the mass of the latch and/or the inertia activated blocking mechanism.

SUMMARY OF THE INVENTION

In one embodiment, a vehicle latch is provided herein. The vehicle latch having: a claw rotationally mounted to the latch for movement about an axis; a pawl rotationally mounted to the latch for movement about an axis between a first position and a second position, wherein the pawl restricts movement of the claw when it is in the first position and wherein the pawl does not restrict movement of the claw when it is in the second position; and an inertia locking device for limiting movement of the pawl towards the second position, wherein the inertia locking device includes a mass-spring damper system configured to react to acceleration forces applied to the pawl in order to limit the movement of the pawl.

In addition to one or more features described above, or as an alternative to any of the foregoing embodiments, the inertia locking device may further include a first member rotatably mounted to the latch for movement about an axis between a first position and a second position.

In addition to one or more features described above, or as an alternative to any of the foregoing embodiments, the inertia locking device may further include a blocking member rotatably mounted to the first member for movement about an axis.

In addition to one or more features described above, or as an alternative to any of the foregoing embodiments, when the first member is in the first position, an engagement surface of the first member may be positioned to contact a surface of the pawl such that rotation of the pawl towards its second position is prohibited.

In addition to one or more features described above, or as an alternative to any of the foregoing embodiments, the blocking member may be configured to contact a protrusion of the latch such that rotation of the first member towards the second position is prohibited.

In addition to one or more features described above, or as an alternative to any of the foregoing embodiments, the blocking member may have a first arm member and a second arm member, the first arm member being configured to contact the protrusion when the blocking member is in the first position and wherein the second arm member is operably coupled to the mass-spring damper system.

In addition to one or more features described above, or as an alternative to any of the foregoing embodiments, the mass-spring damper system may be secured to a portion of the first member such that as first member rotates the axis the mass-spring damper system also moves.

In addition to one or more features described above, or as an alternative to any of the foregoing embodiments, further embodiments may include a spring configured to provide a biasing force to first member such that first member is spring biased into its first position.

In addition to one or more features described above, or as an alternative to any of the foregoing embodiments, further embodiments may include a spring configured to provide a biasing force to first member such that first member is spring biased into its first position.

In addition to one or more features described above, or as an alternative to any of the foregoing embodiments, the blocking member may have a first arm member and a second arm member, the first arm member being configured to contact a protrusion when the blocking member is in the first position and wherein the second arm member is operably coupled to the mass-spring damper system.

In addition to one or more features described above, or as an alternative to any of the foregoing embodiments, the mass-spring damper system may have an arm that is rotatably coupled to arm at one end and is received in a housing of the mass-spring damper system at the other end.

In addition to one or more features described above, or as an alternative to any of the foregoing embodiments, an end of the arm that is received in housing may be coupled to a piston slidably received within housing and a fluid is disposed between piston and an end of an internal cavity of housing wherein the fluid provides a resistive force to the piston as it slides within housing.

In addition to one or more features described above, or as an alternative to any of the foregoing embodiments, further embodiments may include a release lever configured to apply rotational forces to the pawl and the inertia locking device.

In addition to one or more features described above, or as an alternative to any of the foregoing embodiments, the release lever may be operatively coupled to a release handle.

In addition to one or more features described above, or as an alternative to any of the foregoing embodiments, the mass-spring damper system may prevent movement of the pawl when an acceleration force greater than a predetermined valve is applied to the pawl.

In addition to one or more features described above, or as an alternative to any of the foregoing embodiments, the first member may be spring biased into the first position.

In yet another embodiment, a method of limiting movement of a pawl of a vehicle latch is provided. The method including the steps of: rotationally mounting a claw to the latch for movement about an axis; rotationally mounting a pawl to the latch for movement about an axis between a first position and a second position, wherein the pawl restricts movement of the claw when it is in the first position and wherein the pawl does not restrict movement of the claw when it is in the second position; and limiting movement of the pawl towards the second position with an inertia locking device, wherein the inertia locking device includes a mass-spring damper system configured to react to acceleration forces applied to the pawl in order to limit the movement of the pawl.

In addition to one or more features described above, or as an alternative to any of the foregoing embodiments, the inertia locking device may include a first member rotatably mounted to the latch for movement about an axis between a first position and a second position.

In addition to one or more features described above, or as an alternative to any of the foregoing embodiments, the inertia locking device may include a blocking member rotatably mounted to the first member for movement about an axis.

In addition to one or more features described above, or as an alternative to any of the foregoing embodiments, when the first member is in the first position, an engagement surface of the first member may be positioned to contact a surface of the pawl such that rotation of the pawl towards its second position is prohibited.

BRIEF DESCRIPTION OF THE DRAWINGS

These and/or other features, aspects, and advantages of the present invention will become better understood when the following detailed description is read with reference to the accompanying drawings in which like characters represent like parts throughout the drawings, wherein.

Although the drawings represent varied embodiments and features of the present invention, the drawings are not necessarily to scale and certain features may be exaggerated in order to illustrate and explain exemplary embodiments the present invention. The exemplification set forth herein illustrates several aspects of the invention, in one form, and such exemplification is not to be construed as limiting the scope of the invention in any manner.

DETAILED DESCRIPTION

Figure 1:
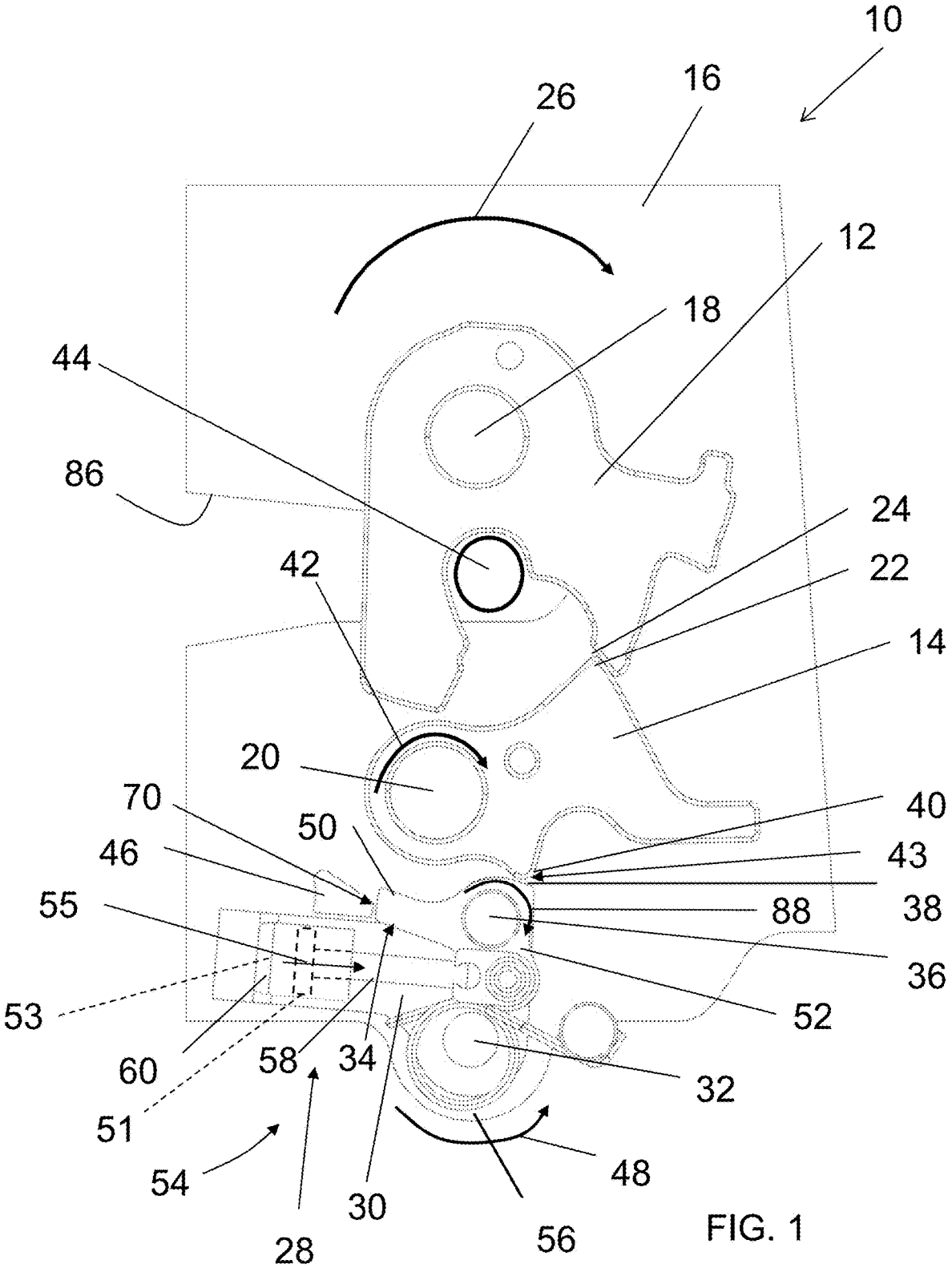
FIG. 1 is a view of a vehicle latch wherein the vehicle latch and its associated inertia locking device or inertia lever is in a first or locking position.

Referring now to the FIGS, portions of a vehicle latch 10 according to embodiments of the present invention are illustrated. In FIG. 1, the vehicle latch 10 is in a first or locked position wherein a fork bolt or claw 12 is in a closed position and a detent lever or pawl 14 is in an engaged position. The fork bolt or claw 12 is rotatably mounted to a frame or housing 16 of the latch 10 for movement about an axis 18 and the pawl or detent lever 14 is rotatably mounted to the frame or housing 16 of the latch 10 for movement about an axis 20.

As illustrated in FIG. 1, a contact surface 22 of the pawl 14 engages a contact surface 24 of the claw 12 in order to prevent rotation of the claw 12 in the direction of arrow 26 towards an open position. Also shown in FIG. 1 is an inertia locking device 28. The inertia locking device 28 has a first member 30 rotatably mounted to the housing 16 for movement about an axis 32. The inertia locking device 28 further comprises a blocking member 34 rotatably mounted to the first member 30 for movement about an axis 36.

As illustrated, in FIG. 1, the first member 30 and the blocking member 34 are each in a first or blocking position. When the first member 30 is in the first or blocking position, an engagement surface 38 of the first member 30 is positioned to contact a surface 40 of the detent lever or pawl 14 such that rotation of the detent lever or pawl 14 in the direction of arrow 42 is prohibited and thus, the detent lever or pawl 14 cannot move from the engaged position of FIG. 1 and thus, the claw or fork bolt 12 remains in the closed or latched position illustrated in FIG. 1. As illustrated in FIG. 1 a small gap 43 is located between engagement surface 38 and surface 40.

When the fork bolt or claw 12 is in the closed or latched position a striker 44 is retained by the latch 10. As such, latch 10 may be used with a vehicle door in order to close/latch or open/unlatch the door.

Blocking member 34 is configured to contact or engage a protrusion or feature 46 of the latch 10 and/or the housing 16 such that rotation of the first member 30 in the direction of arrow 48 about axis 32 is prohibited and thus movement of the detent lever or pawl 14 from the engaged position in the direction of arrow 42 is also prohibited and thus, the latch 10 remains in a latched state. In one embodiment, the blocking member 34 may have a first arm member 50 and a second arm member 52. The first arm member 50 is configured to contact the feature 46 when the blocking member 34 is in the first position. The second arm member 52 is configured to be operably coupled to a mass-spring damper system (MSDS) 54 which is configured to maintain the blocking member 34 in the first position. In one embodiment, the mass-spring damper system (MSDS) 54 is secured to a portion of the first member 30 such that as first member 30 rotates about axis 32, the mass-spring damper system (MSDS) 54 also moves.

A spring 56 is also provided to provide a biasing force to first member 30 in a direction opposite to that of arrow 48 such that first member 30 is spring biased into the first position.

The mass-spring damper system (MSDS) 54 has a shaft or arm 58 that is rotatably coupled to arm 52 at one end and is received in a housing 60 of the mass-spring damper system (MSDS) 54 at the other end. The opposite end of shaft or arm 58 received in housing 60 may be operatively coupled to a piston 51 slidably received within housing 60. In one embodiment, a fluid 53 (e.g., air or liquid) may be disposed between piston 51 and an end of the internal cavity of housing 60. This fluid can be configured to tune the operation of mass-spring damper system (MSDS) 54 in order to provide a resistive force in the direction of arrow 55 depending on a force applied by shaft 58 in a direction opposite to arrow 55. In an alternative embodiment, fluid 53 may be replaced by a spring located between piston 51 and an internal wall of housing 60. Alternatively and in yet another embodiment both a fluid and spring may be located between piston 51 and an internal wall of housing 60. In addition, the entire mass of the mass-spring damper system (MSDS) 54 configured to rotate about axis 32 may also be tuned to rotate about axis 32 when it is subjected to predetermined forces that will overcome the biasing force of spring 56.

Figure 2:
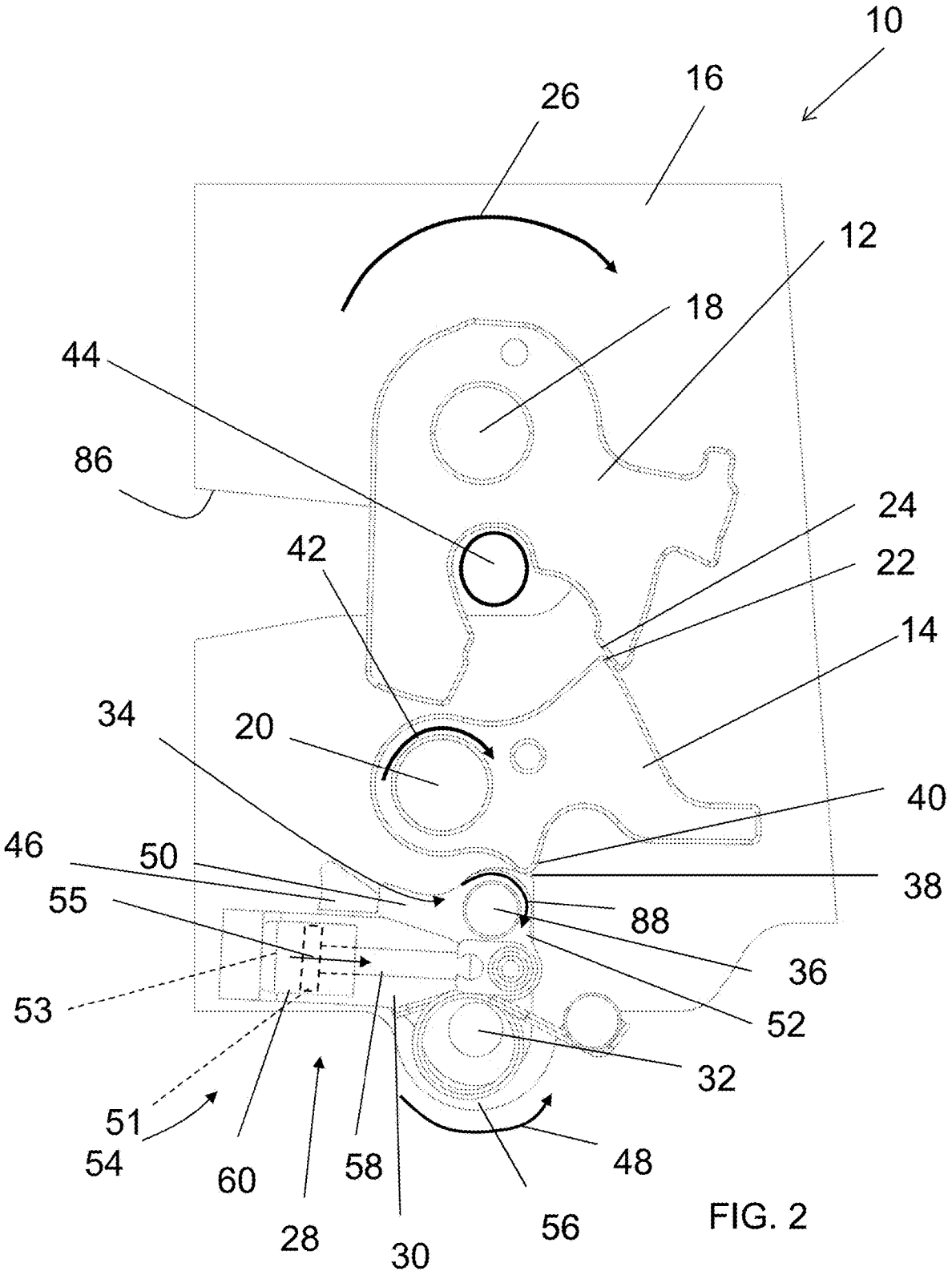
FIG. 2 is a view of the vehicle latch of FIG. 1 wherein the vehicle latch and its associated inertia locking device or inertia lever are subject to forces or g-forces not attributed to a user activated opening force and wherein the inertia locking device or inertia lever remains in an active or locking position.

During an impact or side impact or any other application of forces to the vehicle and/or vehicle door the latch 10 is associated with, wherein a moment of inertia of the pawl or detent lever 14 is exceed such that pawl or detent lever 14 is rotated in the direction of arrow 42. The mass-spring damper system (MSDS) 54 will maintain blocking member 34 in its first position such that arm 50 will contact feature 46 and retain blocking member 34 in its first position, which by virtue of blocking member 34 being secured to first member 30 will retain the first member 30 in its first position such that rotational movement of the detent lever or pawl 14 in the direction of arrow 42 will be prohibited as surface 38 will contact surface 40. This is illustrated in FIG. 2 wherein gap 43 between surface 38 and surface 40 is no longer visible and a gap 70 located between protrusion 46 and arm member 50 is no longer visible. Accordingly, the mass-spring damper system (MSDS) 54 in conjunction with first member 30 and blocking member 34 prevents movement of detent lever or pawl 14 in the direction of arrow 42, which ultimately prevents rotational movement of claw or fork bolt 12 in the direction of arrow 26.

In one embodiment, the mass-spring damper system (MSDS) 54 is configured to limit movement of blocking member 34 when a predetermined acceleration or force is applied to detent lever or pawl 14. In one embodiment, the predetermined acceleration is greater than that typically associated with a user activated latch opening event. In other words, the acceleration forces applied to the pawl or detent lever 14 in response to user manipulation of release lever 72 via handle 74 are less than those associated with an impact to the vehicle. As such and when the lower acceleration forces are applied to the release lever 72 via handle 74 the mass-spring damper system 54 is configured to allow for the aforementioned rotation of blocking member 34 and first member 30 into their respective second positions such that the latch 10 can be opened.

Figure 3:
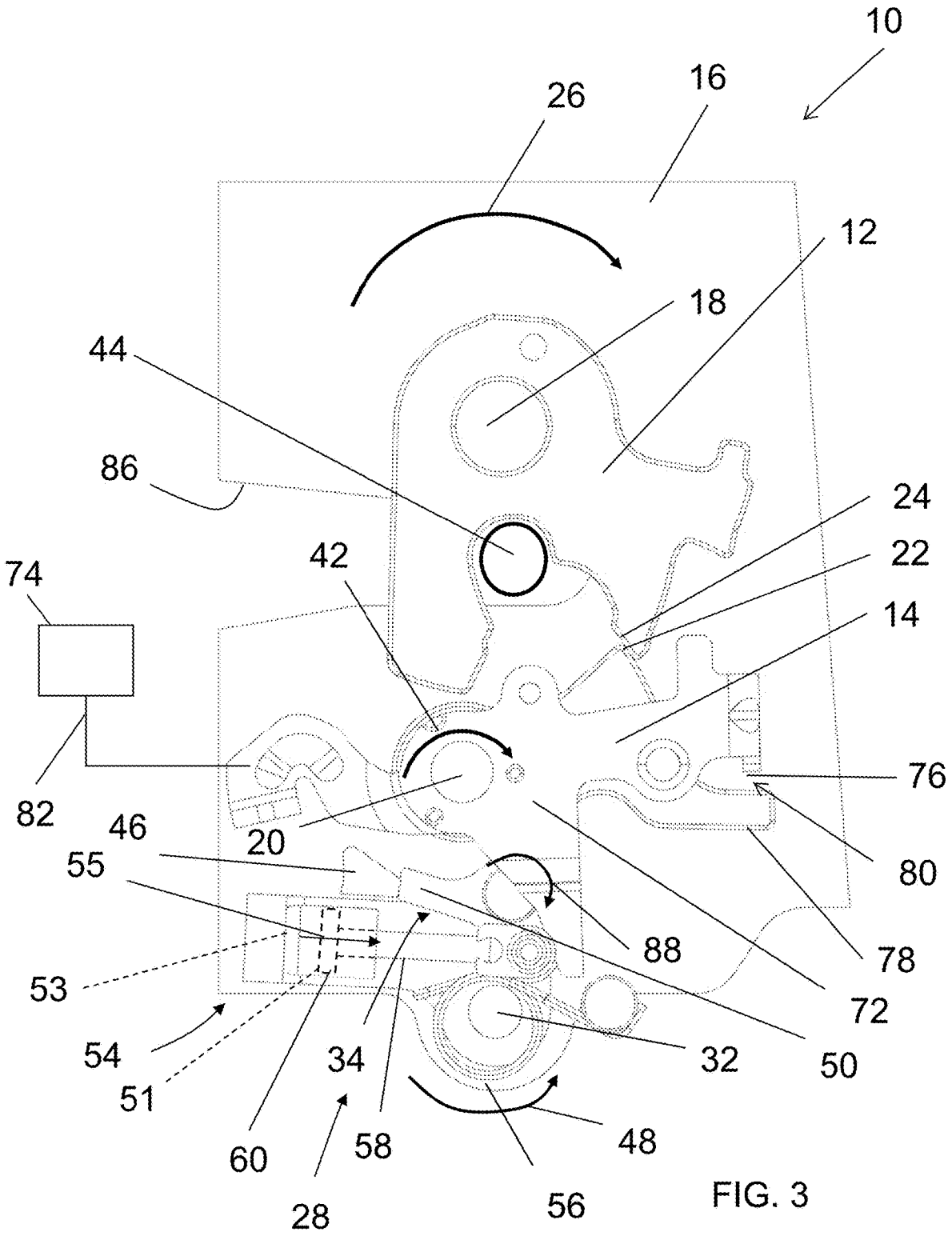
FIG. 3 is a view of FIG. 2 illustrating the location of the release lever with respect to the detent lever or pawl and the inertia locking device or inertia lever.

Referring now to FIG. 3, a release lever 72 is shown mounted to latch 10. In FIGS. 1 and 2, the release lever 72 was not illustrated in order to visibly illustrate other components of the latch 10. Release lever 72 is rotationally mounted to the latch 10 for rotation about axis 20. Release lever 72 is operatively coupled to a release handle 74, which may be either an inside release handle or an outside release handle in order to operate the latch 10 and transition it from a latched or close state to an unlatched or open state. In one alternative, release handle 74 may be operatively coupled to both an inside release handle and an outside release handle. Release lever 72 has a contact portion 76 that is configured to make contact with an arm member or contact portion 78 of detent lever or pawl 14.

In FIG. 3, detent lever or pawl 14 and first member 30 are in the positions illustrated in FIG. 2 (external force applied to the vehicle latch 10). Accordingly, a gap 80 is present between contact portion 76 and arm member or contact portion 78 of detent lever or pawl 14.

Figure 4:
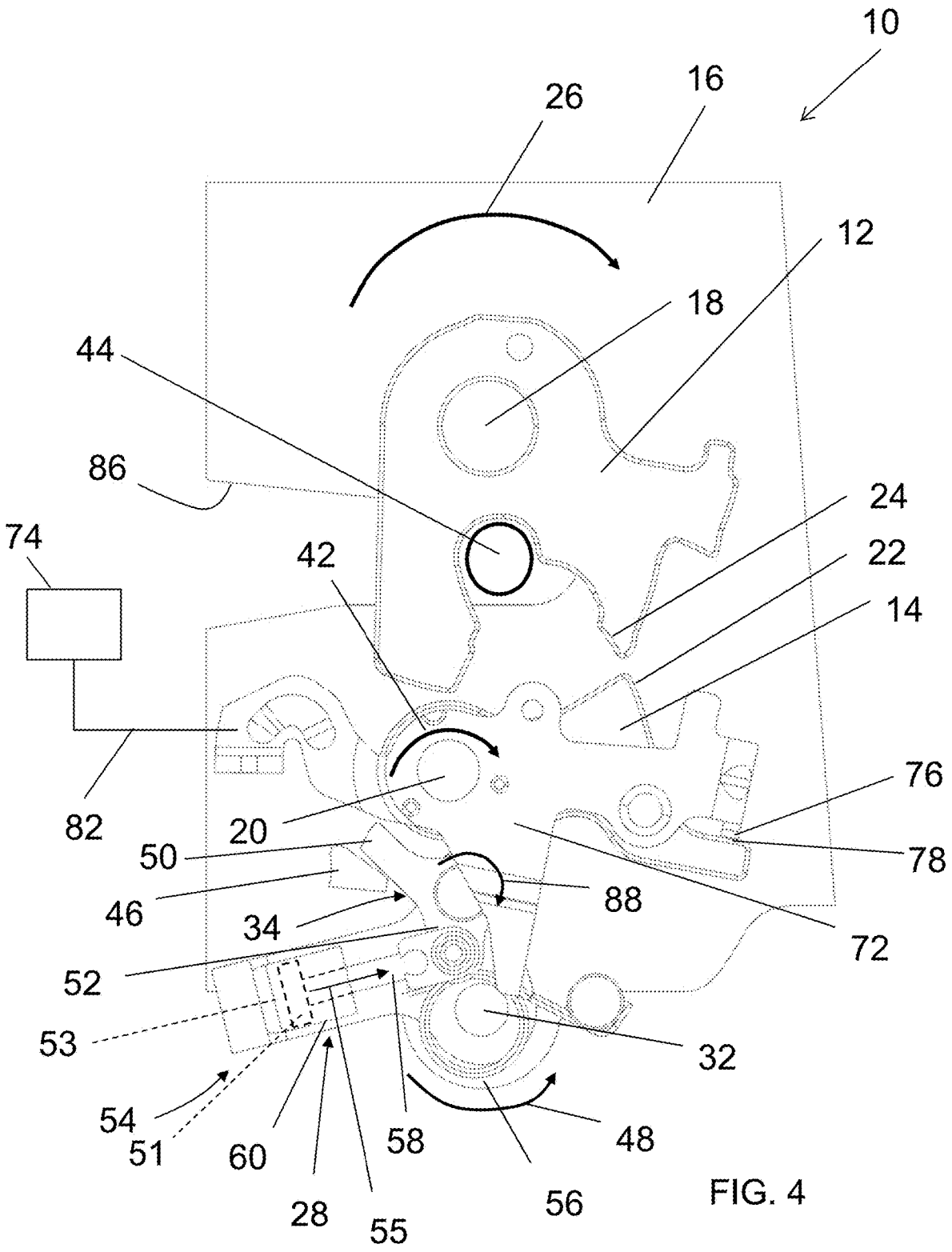
FIG. 4 is a view of the vehicle latch of FIG. 1 wherein the vehicle latch and its associated inertia locking device or inertia lever and detent lever or pawl are subject to forces attributed to a user activated opening force and speed.

Referring now to FIG. 4, release of the vehicle latch 10 via release lever 72 in accordance with user applied force to handle 74 is illustrated. Here the user applied force to handle 74 is transferred to release lever 72 via cables and/or rods 82 that operatively couple handle 74 to release lever 72. In order to rotate release lever 72 in the direction of arrow 42 about axis 20 an operator applies a force to handle 74 which is transferred to release lever 72 via cables and/or rods 82 such that release lever 72 can rotate in the direction of arrow 42 about axis 20.

Once this occurs, contact portion 76 makes contact with contact portion or arm 78 and thus applies a rotational force to detent lever or pawl 14 in the direction of arrow 42 about axis 20. In addition, another surface of the release lever 72 makes contact with blocking member 34 and rotates the same such about axis 36 in the direction of arrow 88 such that arm 50 will no longer contact protrusion or feature 46 and thus first member 30 may rotate in the direction of arrow 48 about axis 32 via contact of surfaces 38 and 40 as detent lever or pawl 14 rotates in the direction of arrow 42 about axis 20. Once the surface 22 of detent lever or pawl 14 is no longer in contact with surface 24 of claw or fork bolt 12 and thus detent lever or pawl 14 is in a second position, claw or fork bolt 12 can rotate in the direction of arrow 26 about axis 18 into a second position such that striker 44 can be released from a throat or opening 84 of fork bolt or claw 12 and a corresponding slot or opening 86 of latch 10.

In accordance with various embodiments of the present invention the inertia locking device 28 is movably mounted to the latch 10 so that it is located within a housing 16 of the vehicle latch 10. In one embodiment, the inertia locking device 28 is movably mounted to the housing 14 or alternatively to any other portion of the latch 10.

The inertia locking device 28 has a mass-spring damper system (MSDS) 54, which allows the system and the latch 10 to be adjustable to react to different accelerations without having to increase a mass of the components of the inertia locking device 28. The mass-spring damper system (MSDS) 54 includes a damper mechanism integrated into the system which is operatively coupled to the blocking member 34 has a direct influence on the acceleration of the movement of the detent lever or pawl 14.

Accordingly, the inertia locking device 28 is configured to react based upon the speed or acceleration of the detent lever or pawl 14 in the direction of arrow 42 and based upon the speed acceleration of the detent lever or pawl 14 in the direction of arrow 42 the mass-spring damper system 54 can be tuned based on the factor of dampening of this damper and thus, the inertia locking device can be tuned to react to different accelerations without necessarily increasing the mass of the components of the inertia locking device 28.

Therefore, the inertia locking device 28 of various embodiments of the present invention will make it easier to adjust the same to react to the different inputs on the system, such as speed, acceleration, and/or other perturbations.

As used herein, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. In addition, it is noted that the terms "bottom" and "top" are used herein, unless otherwise noted, merely for convenience of description, and are not limited to any one position or spatial orientation.

The modifier "about" used in connection with a quantity is inclusive of the stated value and has the meaning dictated by the context (e.g., includes the degree of error associated with measurement of the particular quantity). While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A vehicle latch, comprising:

a claw rotationally mounted to the latch for movement about an axis;

a pawl rotationally mounted to the latch for movement about an axis between a first position and a second position, wherein the pawl restricts movement of the claw when it is in the first position and wherein the pawl does not restrict movement of the claw when it is in the second position; and an inertia locking device for limiting movement of the pawl towards the second position, the inertia locking device including a first member rotatably mounted to the latch for movement about an axis between a first position and a second position and a blocking member rotatably mounted to the first member for movement about an axis wherein the inertia locking device includes a mass-spring damper system configured to react to acceleration forces applied to the pawl in order to limit the movement of the pawl, the mass-spring damper system including an arm rotatably secured to the blocking member.

2. The vehicle latch as in claim 1 wherein when the first member is in the first position, an engagement surface of the first member is positioned to contact a surface of the pawl such that rotation of the pawl towards its second position is prohibited.

3. The vehicle latch as in claim 2, wherein the blocking member is configured to contact a protrusion of the latch such that rotation of the first member towards the second position is prohibited.

4. The vehicle latch as in claim 3, wherein the blocking member has a first arm member and a second arm member, the first arm member being configured to contact the protrusion when the blocking member is in the first position and wherein the second arm member is operably coupled to the arm of the mass-spring damper system.

5. The vehicle latch as in claim 1 wherein the mass-spring damper system is secured to a portion of the first member such that as first member rotates about the axis between the first position and the second position, the mass-spring damper system also moves.

6. The vehicle latch as in claim 5, further comprising a spring configured to provide a biasing force to first member such that first member is spring biased into its first position.

7. The vehicle latch as in claim 1, further comprising a spring configured to provide a biasing force to first member such that first member is spring biased into its first position.

8. The vehicle latch as in claim 1, wherein the blocking member has a first arm member and a second arm member, the first arm member being configured to contact a protrusion when the blocking member is in the first position and wherein the second arm member is operably coupled to the mass-spring damper system.

9. The vehicle latch as in claim 8, wherein the arm of the mass-spring damper system is rotatably coupled to the second arm at one end and is received in a housing of the mass-spring damper system at the other end.

10. The vehicle latch as in claim 9, wherein an end of the arm that is received in housing is coupled to a piston slidably received within housing and a fluid is disposed between piston and an end of an internal cavity of housing wherein the fluid provides a resistive force to the piston as it slides within housing.

11. The vehicle latch as in claim 10, wherein the release lever is operatively coupled to a release handle.

12. The vehicle latch as in claim 1, further comprising a release lever configured to apply rotational forces to the pawl and the inertia locking device.

13. The vehicle latch as in claim 1, wherein the mass-spring damper system prevents movement of the pawl when an acceleration force greater than a predetermined value is applied to the pawl.

14. The vehicle latch as in claim 1, wherein the first member is spring based into the first position.

15. A method of limiting movement of a pawl of a vehicle latch, comprising:

rotationally mounting a claw to the latch for movement about an axis;

rotationally mounting a pawl to the latch for movement about an axis between a first position and a second position, wherein the pawl restricts movement of the claw when it is in the first position and wherein the pawl does not restrict movement of the claw when it is in the second position; and limiting movement of the pawl towards the second position with an inertia locking device, the inertia locking device including a first member rotatably mounted to the latch for movement about an axis between a first position and a second position and a blocking member rotatably mounted to the first member for movement about an axis, wherein the inertia locking device includes a mass-spring damper system configured to react to acceleration forces applied to the pawl in order to limit the movement of the pawl, the mass-spring damper system including an arm rotatably secured to the blocking member.

16. The method as in claim 15, wherein when the first member is in the first position, an engagement surface of the first member is positioned to contact a surface of the pawl such that rotation of the pawl towards its second position is prohibited.

* * * * *